United States Patent [19]

Fujita et al.

[11] Patent Number: 4,773,086

[45] Date of Patent: Sep. 20, 1988

[54] OPERATOR CONSOLE FOR X-RAY TOMOGRAPHS

[75] Inventors: Kenjiro Fujita; Isao Matsumoto, both of Tokyo, Japan

[73] Assignee: Yokogawa Medical Systems, Limited, Tokyo, Japan

[21] Appl. No.: 117,363

[22] Filed: Oct. 28, 1987

Related U.S. Application Data

[63] Continuation of Ser. No. 871,179, Jun. 4, 1986, abandoned, which is a continuation of Ser. No. 598,976, Apr. 11, 1984, abandoned.

[30] Foreign Application Priority Data

Dec. 16, 1983 [JP] Japan ..... 58-237386

[51] Int. Cl.[4] ..... H05G 1/00

[52] U.S. Cl. ..... 378/4; 378/114; 378/116

[58] Field of Search ..... 378/4, 20, 114–116, 378/98; 340/712, 365 VL, 286 M, 525

[56] References Cited

U.S. PATENT DOCUMENTS

| | | | |
|---|---|---|---|
| 3,187,321 | 6/1965 | Kameny | 340/365 VL |
| 3,916,192 | 10/1975 | Schmitmann et al. | 378/98 |
| 4,137,571 | 1/1979 | Pfeifer | 378/116 |
| 4,160,906 | 7/1979 | Daniels et al. | 376/115 |
| 4,234,928 | 11/1980 | Pfeifer | 378/116 |
| 4,247,777 | 1/1981 | Pfeifer | 378/116 |
| 4,250,386 | 2/1981 | Pfeifer | 378/116 |
| 4,251,729 | 2/1981 | Pfeifer | 378/116 |
| 4,255,662 | 3/1981 | Waterkamp | 378/116 |

FOREIGN PATENT DOCUMENTS

| | | | |
|---|---|---|---|
| 2655661 | 6/1978 | Fed. Rep. of Germany | 378/4 |

*Primary Examiner*—Janice A. Howell
*Assistant Examiner*—David P. Porta
*Attorney, Agent, or Firm*—Moonray Kojima

[57] ABSTRACT

An operator console for an X-ray tomograph, has a variety of switches sequentially actuatable for scanning operation of the X-ray tomograph. Each switch is provided with an indicator means for indicating a controllable condition to give the operator a switch operating procedure, and also with an indicator means for indicating a selected condition to allow the operator to know a current setting at a glance. The number of operating steps for routine scanning operation can be reduced by providing capability for presetting scanning parameters for respective body areas to be scanned. The operator console can easily be operated without any errors even by a novice operator.

5 Claims, 4 Drawing Sheets

OPERATOR CONSOLE FOR X-RAY TOMOGRAPHS

This is a continuation of U.S. Ser. No. 06/871179 filed 6-4-86 which is a continuation of Ser. No. 06/598976, filed 4-11-84 both abandoned.

BACKGROUND OF THE INVENTION

1. Field of Invention

This invention relates to an X-ray computerized tomograph (hereinafter called "X-ray CT"), and more particularly to an operator console for inputting scanning conditions of the X-ray CT.

2. Description of Prior Art

Computerized tomographs are known in the art, which emit an X-ray beam at a number of angles in a plane across a subject or a patient, and determine a distribution of X-ray absorptivities of various body sections, and display the absorptivity distribution on a screen of a display unit.

FIGS. 1 1(A) (B), and 1(C) depict the main components of a general X-ray CT. FIG. 1(A) illustrates a scanning gantry 1 and a patient table 2. Scanning gantry 1 has therein an X-ray tube and an X-ray detecting device (not shown) which are disposed in confronting relation to each other across an opening. Table 2 includes a cradle 4 axially slidable forward into opening 3, or backward out of opening 3, while carrying a subject or a patient (not shown) thereon, for exposure to the X-ray in gantry 1.

FIG. 1(B) shows a computer for controlling the overall X-ray CT and effecting computations for image reconstruction, for example.

FIG. 1(C) depicts an operator console having a variety of switches disposed on a panel thereof and selectively actuable for scanning operation of the X-ray CT, and a cathode ray tube 5 (hereinafter called "CRT").

In operating the X-ray CT of the above configuration, pieces of information, such as scanning conditions, are inputted normally through scanning operation on the operator console. Methods of entering such information include (1) a conversation or interactive process using a keyboard on the operator console while watching messages displayed on the CRT of the console; and (2) process of selectively actuating the switches on the panel of the console.

Method (1) is , however, disadvantageous, in that the operator must become experienced in keyboarding. It takes time to master operation of the CT. Numerous erroneous control operations tend to occur, since the operator is required to do the keyboarding while looking at the messages on the CRT.

Method (2) has a problem, in that, that the switches cannot be properly actuated unless the operator knows the correct switching operating sequence.

The scanning of the X-ray CT comprise such conditions as field of view (FOV), scanning time, current to flow through the X-ray tube for generating an X-ray, slicing interval, thickness to be sliced, and other parameters. In known CTs, (a) scan parameters are set while watching messages displayed on the CRT in a conversation or interactive process, or (b) scan parameters are selected and set by various selecting and setting switches on the panel each time the patients are changed or scan parameters are changed. Once an anatomy section to be scanned has been determined, a predetermined combination of scanning conditions or parameters, which are tailored to a particular hospital, is usually available for most of the scans thereat. However, with the above processes (a) and (b), scan parameters have to be established in each scanning operation, even when scanning is to be effected under routine conditions. Thus, prior parameter setting has been tedious and time consuming.

SUMMARY OF THE INVENTION

Accordingly, an object of the invention is the improve the prior art, and to overcome the aforementioned and other deficiencies and disadvantages of the prior art.

Another object is to provide an operator console for X-ray computerized tomographs which allows various pieces of information to be entered easily without error, even when operated by a novice operator.

The foregoing and other objects are attained in the invention which encompasses an operator console for an X-ray Tomograph, comprising a scan parameter display for displaying scan parameters for scanning operation of the X-ray tomograph, means for presetting the scan parameters, means for storing the preset scan parameters, switch means for manually changing the preset scan parameters, a plurality of scanning control switches for indicating the scanning operation, display output circuits for displaying controllable conditions and selected conditions of the scanning control switches, to allow the scanning control switches to be individually operated on, and means for controlling the display output circuits to display a controllable condition of a switch to be selected next according to a scanning control procedure and to display a selected condition of a selected switch and for controlling the presetting means to preset the scan parameters for each anatomy section to be scanned.

DETAILED DESCRIPTION OF PREFERRED EMBODIMENTS.

Figure 1A:
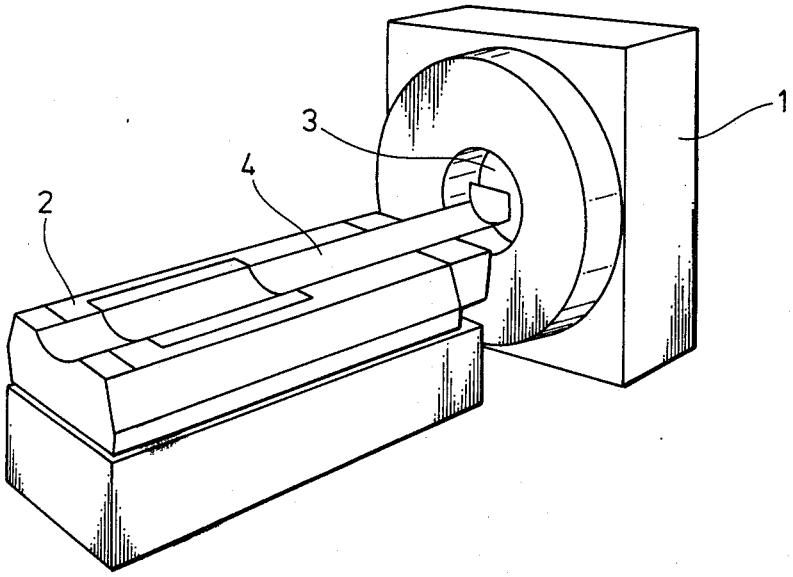
FIGS. 1 (A), 1(B) and 1(C) are perspective view of major components of a general X-ray CT.
Figure 1B:
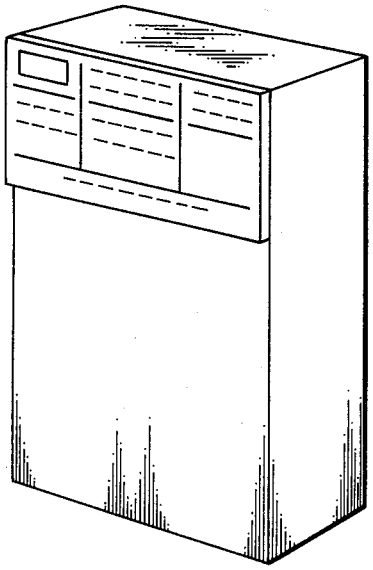
Figure 1C:
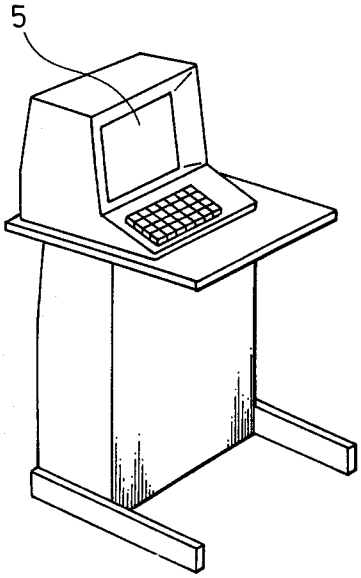
Figure 2:
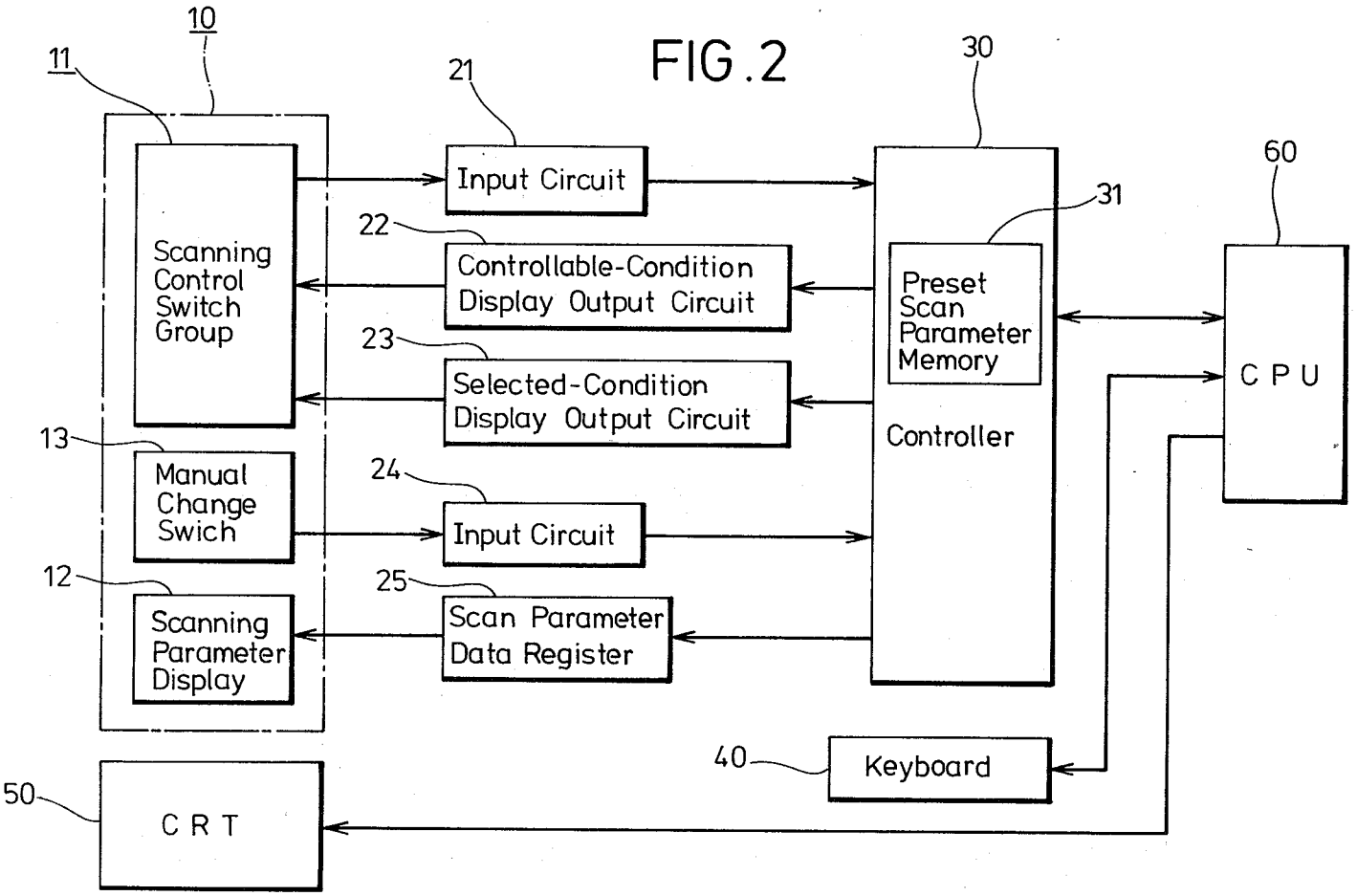
FIG. 2 is a block diagram of a circuit arrangement of an illustrative embodiment of the invention.

FIG. 2 is a block diagram depicting a circuit arrangement used in the operator console of the invention. The circuit arrangement comprises a scanning control panel 10, a controller 30 for receiving scanning information from scanning control panel 10 and feeding data and control signal to scanning control panel 10, a keyboard 40, a cathode ray tube (CRT) monitor 50, for displaying images and characters, and a central processing unit 60 (called "CPU"), comprising a computer for issuing necessary data and control signals to the components of the operator console.

Figure 3:
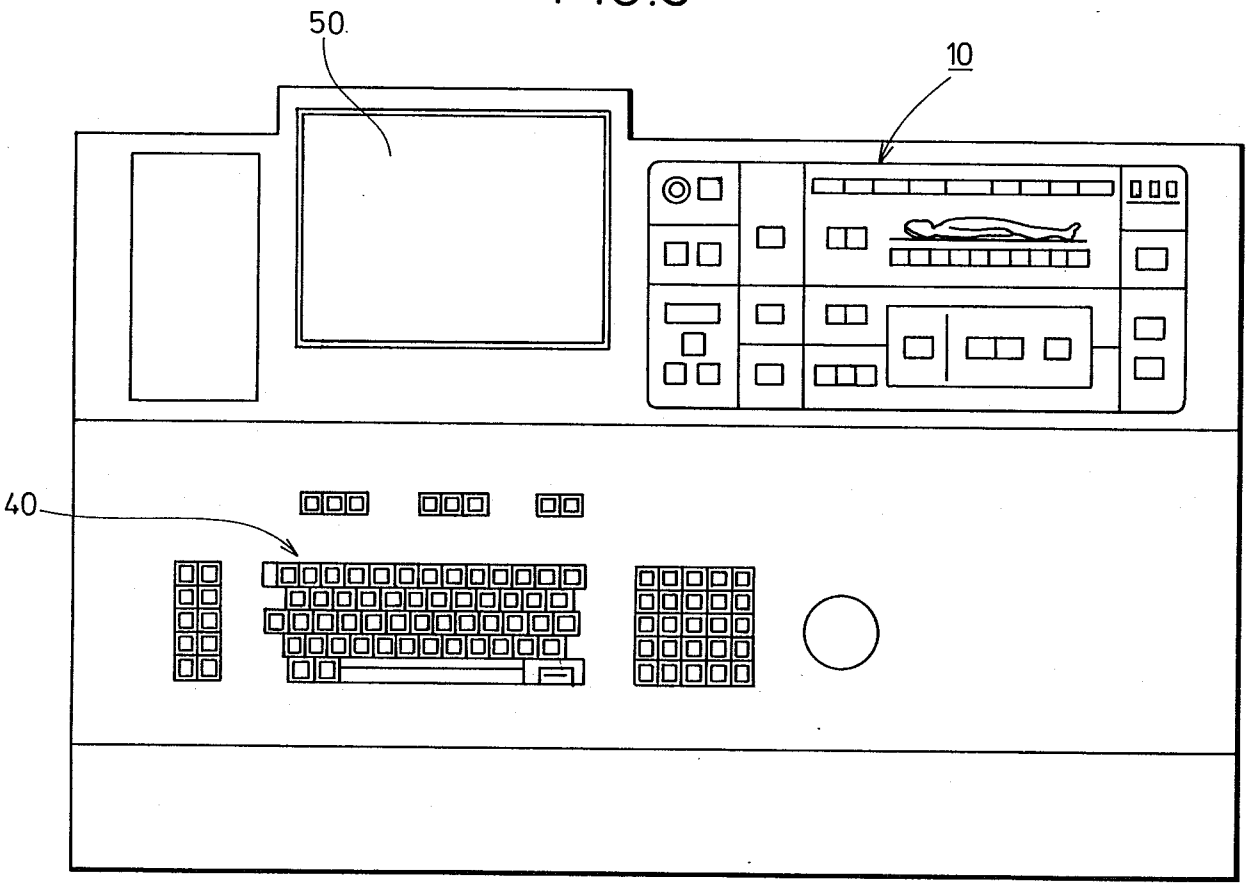
FIG. 3 is a front elevational view of the console of the embodiment.

FIG. 3 depicts the exterior construction of the operator console with keyboard 40 in a front position, CRT 50 in a left upper position on a slanted surface behind keyboard 40, and scanning control panel 10 on the right of CRT 50.

Figure 4:
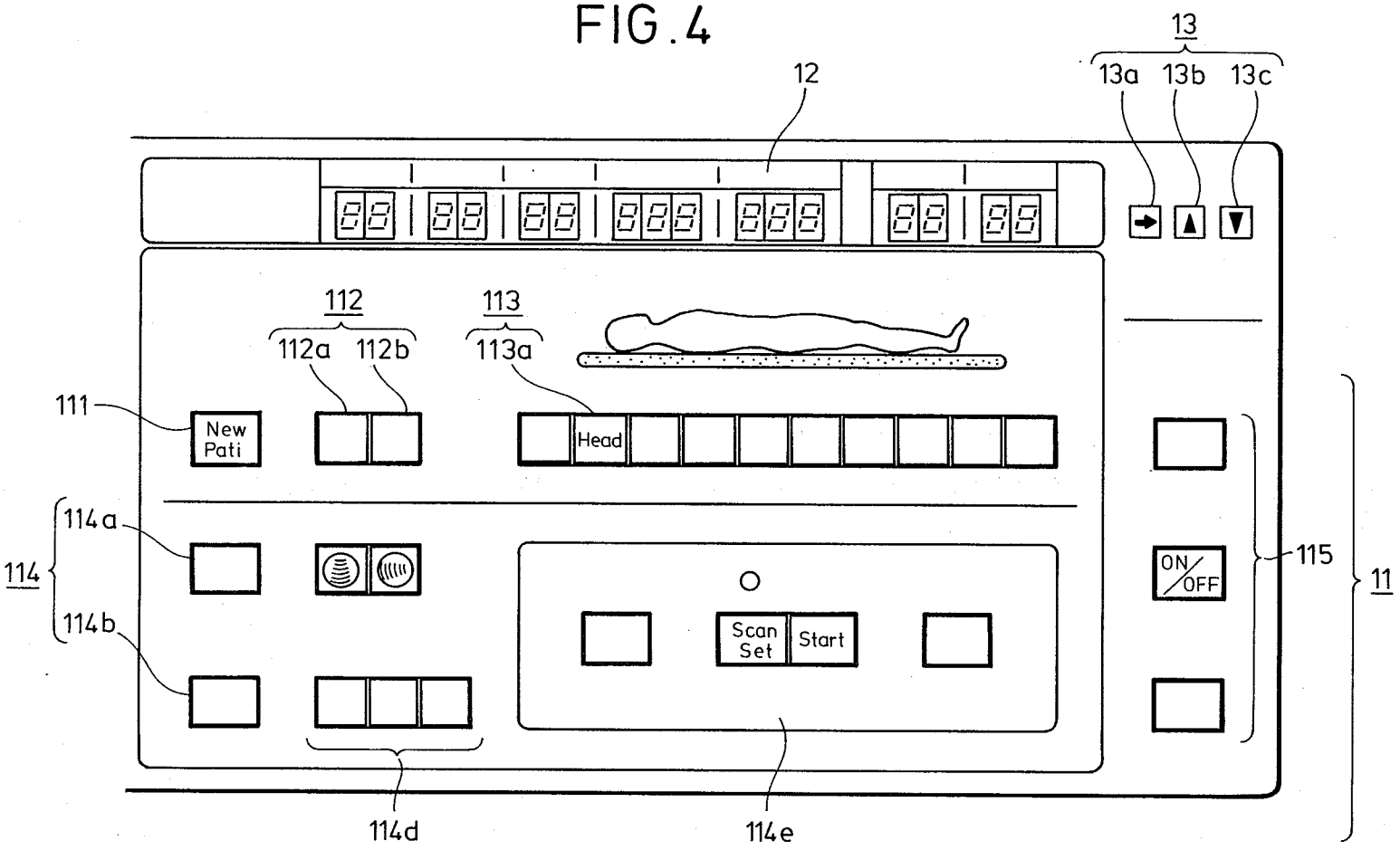
FIG. 4 is an enlarged front elevational view of the embodiment of FIG. 3.

FIG. 4 illustrates in greater detail scanning control panel 10, comprising a scanning control switch group 11, a scan parameter display 12 for displaying scan parameters (numbers "88" and "888" are shown) and manual change switches 13.

Scanning control switch group 11 comprises, for example, a switch 111 for registering a patient's data, a switch 112 for selecting a patient's orientation, a switch 113 for selecting an anatomy section to be scanned, a plurality of switches 114 for selecting scout and axial views and related switches, and power related switches 115 including a power supply switch and other switches.

These switches may comprise pushbutton switches with light emitting means disposed in their caps. The light emitting means may comprise lamps, light emitting diodes, plasma display devices, etc. When such light emitting means is energized in the cap of a pushbutton switch, attention of the operator can be drawn to that particular switch which is energized. The light emitting means need not necessarily be disposed in tne switch caps, but may be located outside of and in the immediate vicinity of the caps.

Although the pushbutton switches are better in controllability, switches based on other principles may be used.

The scanning control switches just described, indicate, for example, a controllable condition when the lamps blink and a selected condition when the lamps are kept continuously energized. A controllable condition display output circuit 22 (see FIG. 2) is responsive to information delivered from controller 30 for blinking the switches. A selected condition display output cirucit 23 is responsive to information delivered from controller 30 for continuously energizing the switches. When a desired switch is depressed, its output is read through an input circuit 21 by controller 30. Inputs from switches other than the blinking switches, are determined as being ineffective by the controller 30. Controller 30 supervises and controls an operation sequence and issues outputs indicative of blinking, continued energization, and de-energization, to the lamps in the switches according to a predetermined sequence.

The scan parameters include a scanning time, a thickness to be sliced, a FOV, a tube current, a slicing interval, and other parameters; and are delivered from controller 30 to a scan parameter register 25 for enabling scan parameter display 12 to indicate the parameters in the numerals in the display areas. Since combinations of the scan parameters vary with anatomy sections to be scanned and scanning modes (transmissive image or sectional image), the scan parameters are displayed at first after an anatomy section to be scanned and a scanning mode, have been selected. Prior to such selection, the display areas are left blank. The values to be displayed thereat in the display areas have been preset. The scan parameters can be preset by entering parameter values through keyboard 40 for each combination of an anatomy section to be scanned and scanning mode. The parameter presetting operation is controlled and prccessed by CPU 60. The preset scan parameters will remain unchanged most of the time once they are tailored according to the diagnostic procedure of the particular user (such as hospital or the like) when the tomograph is installed.

When it is necessary to change any scan parameter from its preset value, manual change switches 13 are depressed. Input signals from the depressed manual change switches are delivered through input circuit 24 to controller 30, which then changes the corresponding scan parameter register 25. Since the content of a preset scan parameter data memory 31 in controller 30 is not rewritten, the original preset values are displayed again when the scanning mode is changed or a next patient scan starts. Controller 30 communicates with CPU 60, as required for the exchange of scanning conditions and sequence information. The preset scan parameters down loaded from CPU 60 into controller 30 when the system starts operating or the preset values are to be changed.

Operation of the operator console will now be described. When the X-ray CT is ready for a next patient, the "new patient" switch 111 (See FIG. 4) is blinking. When switch 111 is depressed, it is then continuously energized, and a list of patients appears on the CRT monitor 50 (see also FIG. 2). Keyboard 40 is operated to enter necessary patient data. Then, one of the patient orientation selector switches, which are now blinking, or "Head First" switch **112*a* or "Feet First" switch 112*b* is selected according to the orientation of the patient (i.e. whether the gantry 1 side is closer to the head or the feet). The selected switch is continuously energized while the other switch is de-energized. Thereafter, anatomy section selector switches 113 start to blink. When the head is to be scanned, the "Head" switch 113*a* is depressed. The "Head" switch 113*a* is now continuously energized, and the other switches in the group of switches 113, are de-energized. The "Scout scan" switch 114*a* and the "Axial Scan" switch 114*b*** then blink. These switches serve to select a scanning mode indicating a transmissive image or a sectional image.

The following description is based on the selection of the axial scan. When the "Axial Scan" switch **114*b* is depressed, this switch is energized, and the "scout Scan" switch 114*a* is de-energized. Simultaneously, the "Single", "Multi-1" and "Multi-2" switches in switch group 114*d* related to the "Axial Scan" switch 114*b* start being energized. At this time, preset values for the axial scan of the head are indicated on the scan parameter display 12**.

In most cases, the operator goes to the next step without changing the preset values. When any preset value is to be changed, the item selector switch **13*a* in the manual change switches 13, is depressed, to select an item to be changed, and a command from the item selector switch 13*a* is given through the input circuit 24 to the controller 30. When the item selector switch 13*a*** is depressed once, only the display unit on the left end is kept lit to indicate selection of the left end item while the other display units are turned darker.

When item selector switch **13*a* is depressed once more, the second display unit from the left end is turned on to indicate selection of the second item, with the left hand end display unit turned darker. After an item to be changed has been selected in this manner, the up scrolling switch 13*b* or the down scrolling switch 13*a***, is depressed to increment or decrement the value in the selected item. The up scrolling or down scrolling switch is released when the desired value is reached. Upon elapse of a few seconds, the darker display units are restored, and the manual change procedure is brought to an end.

When the "Single" switch in the blinking switch group **114*d* is depressed, the other "Multi-1" and "Multi-2" switches are de-energized. Then, the "Scan Set" switch in group 114*e*** blinks. After confirming that the settings selected up to now are correct, the "Scan Set" switch is depressed. The "Scan set" is now continuously energized, and the system is brought into a stage to prepare for a scanning operation. When the system is ready for scanning operation, a "Start" switch starts blinking. The scanning operation is started by depressing the "Start" switch, which will remain energized until the scanning operation is completed.

When the scanning operation is over, a reconstructed tomographic image is displayed on CRT monitor 50 after a short time interval The "Scan Set" switch starts blinking again when the system is ready for a next scanning operation. If the next scanning operation is to be made under the same condition, then the "Scan set" and "Start" switches are depressed as they blink. When it is necessary to change any scan parameter at this time, the manual change switch should be depressed while the "Scan Set" switch is blinking.

As described above, each switch is provided with an indicator means for indicating a controllable condition to give the operator a switch operating procedure, and also with an indicator means for indicating a selected condition to allow the operator to know a current setting at a glance. The number of operating steps for a routine scanning operation can be reduced by providing a capability for presetting scanning parameters for respective body areas to be scanned. The controllable conditions may be represented by dark lighting of the lamps in the switches, or blinking or dark lighting of indicators associated with respective switches. The selected conditions may be represented by continuous energization of indicators associated with respective switches.

While in the illustrative embodiment, the preset scan parameter memory is contained in controller 30 to reduce the number of occurences of communication between CPU 60 and controller 30, the preset scan parameter memory may be contained in CPU 60. Also, the means for manually changing the scan parameters may comprise an increment switch and a decrement switch for each parameter item. Moroever, with the present arrangement of the invention, the operator console for an X-ray CT, can easily be operated without any errors, even by a novice operator, in entering information through the operator console of the invention.

The foregoing description is illustrative of the principles of the invention. Numerous modifications and extensions thereof would be apparent to the worker skilled in the art. All such modifications and extensions are to be considered to be within the spirit and scope of the invention.

What is claimed is:

1. An operator console for a tomograph apparatus comprising an imaging source, an imaging detector and a source scanning means, said console comprising a plurality of scanning control switches, each switch being equipped with a light emitter having a blinking light state, a continuous light state and an unlit state, said blinking light indicating a scanning step to be selected, said continuous light indicating a selected scanning step which has been initiated, wherein said plurality of scanning control switches are divided into a plurality of groups with each group comprising a plurality of scanning control switches, and wherein for each successive group one or more of said plurality of switches having the scanning steps to be selected displayed on the light emitters as blinking lights are successively operated by an operator to produce signals for causing the tomograph to perform the respective scanning steps in the successive groups, whereupon the light emitters on the just operated switches change from a a blinking light to a continuous light to indicate that the scanning step just selected has been initiated;

control means responsive to operation of a scanning control switch for concurrently generating a selected display signal and a plurality of to be selected display signals;

a selected display output means, responsive to said selected display signal applied from said control means, for causing the light emitter asociated with the just operated scanning control switch to change from a blinking light to a continuous light to indicate that the respective control switch has been just operated and the selected scanning step has been initiated; and a to be selected dispaly output means, responsive to said plurality of to be selected display signals applied from said control means, for concurrently causing the light emitters associated with a group of said plurality of scanning control switches next to be operated to change from an unlit state to blinking lights to indicate that one or more of the respective control switches are to be next operated in that group, such that said operator operates in sequence at least one switch in successive groups of said plurality of to be operated switches having the associated light emitter having blinking lights to cause desired scanning steps, whereupon the just operated one or more of the plurality of switches in each successive group have their associated light emitters causes to be changed from blinking lights to continuous lights, and concurrently another successive group of said plurality of to be operated switches have their associated light emitters caused to be changed from unlit states to blinking lights to indicate to the operator the next successive group of said plurality of switches to be operated.

2. The console of claim 1, wherein said switches are push button switches.

3. An operator console for a tomograph apparatus comprising an imaging source, an imaging detector and a source scanning means, said console comprising a plurality of scanning control switchs, each switch being equipped with a light emitter having a blinking light state, a continous light state and an unlit state, said blinking state indicating a scanning step to be selected, said continuous light indicating a selected scanning step which has been initiated, wherein said plurality of scanning control switches are divided into a plurality of groups with each group comprising a plurality of scanning control switches, and wherein for each successive group one or more of said plurality of switches having the scanning steps to be selected displayed on the light emitters as blinking lights are successively operated by an operator to produce signals for causing the tomograph to perform the respective scanning steps in the successive groups, whereupon the light emitters on the just operated switches change from a blinking light to a continuous light to indicate that the scanning step just selected has been initiated, the scanning control switches incorporating switches for designating the selection of an object to be imaged;

a storage means for storing scan parameters preset for each section of the object to be imaged;

a scan parameter display means for displaying the scan parameters;

control means responsive to operation of a scanning control switch for concurrently generating a selected display signal and a plurality of to be selected dispaly signals, and said control means responsive to operation of a scanning control switch designating the section of the object to be imaged for generating a scan parameter display signal;

means responsive to said scan parameter display signal for displaying corresponding parameters of said preset scan parameters stored in said storage means;

a selected display output means, responsive to said selected display signal applied from said control means, for causing the light emitter associated with the just operated scanning control switch to change from a blinking light to a continuous light to indicate that the respective control switch has just been operated and the indicated scanning step has been initiated; and a to be selected display output means, responsive to said plurality of to be selected display signals applied from said control means, for concurrently causing the light emitters associated with a group of said plurality of scanning control switches next to be operated to change form an unlit state to blinking lights to indicate that one or more of the respective control switches are to be next operated in that group, such that said operator operates in sequence at least one switch in successive groups of said plurality of to be operated switches having the associated light emitter having blinking lights to cause desired scanning steps, whereupon the just operated one or more of the plurality of switches in each successive group have their associated light emitters caused to be changed from blinking lights to continuous lights, and concurrently another successive groups of said plurality of to be operated switches have their associated light emitters caused to be changed from unlit states to blinking lights to indicate to the operator the next successive group of said plurality of switches to be operated.

4. The console of claim 3, wherein said switches are push button switches.

5. The console of claim 3, wherein said scan parameter display means includes a register which temporarily holds scan parameters that are used for displaying purposes, the contents of the register being alterable by said operator.

* * * * *